United States Patent [19]

Krause

[11] Patent Number: 4,789,766

[45] Date of Patent: Dec. 6, 1988

[54] WATER-RESISTANT SWITCH CONSTRUCTION

[75] Inventor: W. Barry Krause, Spotsylvania, Va.

[73] Assignee: Tower Manufacturing Corporation, Providence, R.I.

[21] Appl. No.: 124,881

[22] Filed: Nov. 24, 1987

[51] Int. Cl.[4] ..... H01H 21/08

[52] U.S. Cl. ..... 200/302.3; 200/339

[58] Field of Search ..... 200/6 R, 6 B, 6 BA, 200/6 BB, 153 G, 68.1, 68.2, 68.3, 339, 315, 302.1, 302.3

[56] References Cited

U.S. PATENT DOCUMENTS

| | | | |
|---|---|---|---|
| 2,400,849 | 5/1946 | Stearns | 200/68.3 X |
| 3,087,341 | 4/1963 | Hults | 200/302.3 X |
| 3,879,592 | 4/1975 | Comerford et al. | 200/339 X |
| 4,121,071 | 10/1978 | Campbell et al. | 200/339 X |
| 4,127,754 | 11/1978 | Josemans et al. | 200/339 X |
| 4,191,387 | 3/1980 | Kirchoff | 200/302.3 X |
| 4,259,552 | 3/1981 | Swann | 200/68.2 X |
| 4,324,956 | 4/1982 | Sakakino et al. | 200/6 BX |
| 4,352,965 | 10/1982 | Sorenson | 200/339 X |
| 4,482,792 | 11/1984 | Geremia | 200/302.3 |
| 4,686,339 | 8/1987 | Sapone | 200/339 |

*Primary Examiner*—J. R. Scott

*Attorney, Agent, or Firm*—Salter & Michaelson

[57] ABSTRACT

An electrical switch construction includes a housing having an aperture therein, fixed and movable contacts in the housing, an actuator in the housing, and an O-ring in the housing. The actuator includes a substantially hemispherical portion and an actuator arm which extends outwardly from the substantially hemispherical portion and through the aperture in the housing. The actuator arm is pivotably mounted in the housing, and it is manipulatable from the exterior of the housing for moving the movable contact between a position of engagement with the fixed contact and a position of spaced disengagement therefrom. The O-ring is mounted in the interior of the housing so that it extends around the aperture therein, and so that it engages the surface of the substantially hemispherical portion of the actuator to provide a water-resistant seal between the actuator and the housing. The O-ring is maintained in uniformly pressurized engagement with the hemispherical portion of the actuator because the actuator is independently and pivotably mounted with aligned pivot pins in a section of the housing.

The above sentence has been added to the abstract to more clearly describe applicants switch structure and the components which interact with one another to provide a unique hermetic seal.

5 Claims, 1 Drawing Sheet

WATER-RESISTANT SWITCH CONSTRUCTION

BACKGROUND AND SUMMARY OF THE INVENTION

The instant invention relates to electrical switches and more particularly to a water-resistant electrical switch which is adapted for use in connection with small appliances, such as hair dryers and the like.

It has generally been found that each year a significant number of deaths are caused by electrocution when of small appliances, such as hair dryers and the like, are inadvertently dropped into bathtubs or sinks which are filled or partially filled with water. More specifically, it has been found that a significant number of deaths result from short circuiting in the switches of small appliances of this general type when the appliances are immersed in water. In this connection, most of the heretofore available switches for appliances of this general type have not been adapted for water-resistant constructions, and they have generally been susceptible to short circuiting regardless of whether they are in "on" or "off" positions. Hence, many of the heretofore available small appliances, such as hair dryers and the like, have generally presented relatively serious health hazards. Recently, however, an increased awareness of the need to eliminate such health hazards has developed, and as a result a significant need has developed for an effective and economical water-resistant switch construction for small appliances, such as those which are frequently utilized in bathroom areas.

The instant invention provides an effective and economical water-resistant switch construction which is highly resistant to moisture penetration and which is adapted for relatively inexpensive constructions so that it can be effectively utilized in a variety of small appliances, such as hair dryers and the like. More specifically, the instant invention provides a switch construction of the general type comprising a housing including first and second molded plastic housing sections, fixed and movable contacts in the housing, first and second electrical terminals electrically connected in sealed relation to the fixed and movable contacts and a actuator which is pivotably mounted in the housing. The actuator includes an actuator arm which passes through an aperture in the first housing section, and the actuator arm is manipulatable from the exterior of the housing for pivoting the actuator to move the movable contact between a first position wherein it is in engagement with the fixed contact and a second position wherein it is in spaced disengagement from the fixed contact. However, the improvement in the switch construction of the instant invention resides in the fact that it is effectively adapted to resist moisture penetration so that it can be effectively utilized in connection with small appliances, such as those which are intended for bathroom use. Specifically, the switch construction of the instant invention further comprises an O-ring seal which is mounted in the interior of the first housing section so that it extends around the aperture therein, and the actuator includes a substantially hemispherical portion. The actuator is constructed so that the actuator arm extends outwardly from the substantially hemispherical portion, and the actuator is assembled in the switch so that the surface of the subtantially hemispherical portion engages the O-ring to provide a seal between the actuator and the first housing section. The actuator is further assembled in the switch so that the actuator arm passes through the O-ring and then extends outwardly through the aperture in the first housing section. Accordingly, when the actuator arm is manipulated to move the movable contact, the O-ring passes in sealed relation over the surface of the substantially hemispherical portion of the actuator as the actuator is pivoted in the housing. The substantially hemispherical portion of the actuator is preferably made from a low-friction polymer, such as nylon, to enable the Oring to effectively pass over the surface thereof with a minimum of frictional resistance as the actuator is pivoted in the housing, and the first and second housing sections of the switch are preferably ultrasonically sealed together to provide an effective watertight seal therebetween. The first housing section preferably has a substantially circular seat formed therein which extends around the aperture in the first housing section, and the O-ring is preferably received in sealed relation in the seat. Further, the actuator of the switch preferably comprises a spring-biased plunger element which is engageable with the movable contact for moving the movable contact between a first position wherein it is in engagement with the fixed contact and a second position wherein it is in spaced disengagement from the fixed contact. Still further, the switch construction of the instant invention is effectively adapted so that it can be embodied in a variety of different types of water-resistant switches for various specific applications. In particular, the switch construction of the instant invention is adapted so that it can be effectively embodied as a single-pole, single-throw switch; as a single-pole, double-throw switch; as a double-pole, single-throw switch; or as a double-pole, double-throw switch, depending on the intended use. Accordingly, the switch construction of the subject invention may include one or more fixed and/or movable contacts, depending on the specific embodiment.

It has been found that the switch construction of the instant invention can be effectively utilized in connection with various small appliances, such as hair dryers and the like, in order to substantially reduce the hazards which have been heretofore associated with utilizing such appliances in bathroom environments. Specifically, the O-ring seal and the substantially hemispherical portion of the actuator of the switch cooperate to provide an effective seal between the actuator and the housing while nevertheless allowing the actuator to be easily manipulated from the exterior of the housing. Further, the ultrasonic seal between the first and second housing sections effectively eliminates moisture penetration through the housing where the first and second housing sections are joined. Still further, the relative simplicity of the structural features of the switch construction which contribute to substantially reducing the potential for moisture penetration make the switch construction of the instant invention effectively adapted for a variety of relatively inexpensive constructions.

Accordingly, it is a primary object of the instant invention to provide an effective water-resistant switch construction for use in connection with small appliances.

Another object of the instant invention is to provide an economical water-resistant switch construction.

An even further object of the instant invention is to provide an effective water-resistant switch construction which is adapted to be embodied in a variety of different types of switches for various different specific applications.

Other objects, features and advantages of the invention shall become apparant as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
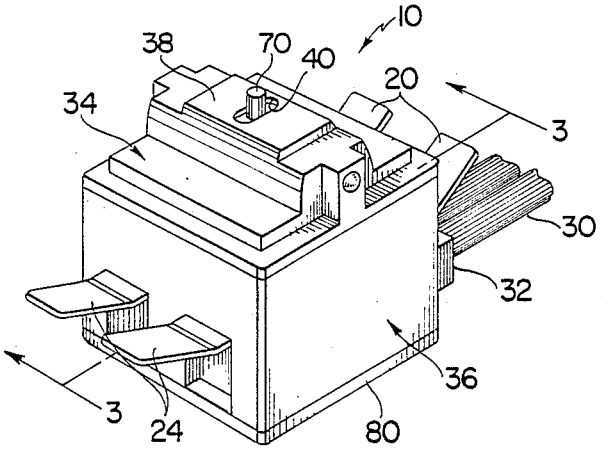
FIG. 1 is a perspective view of the switch construction of the instant invention.
Figure 2:
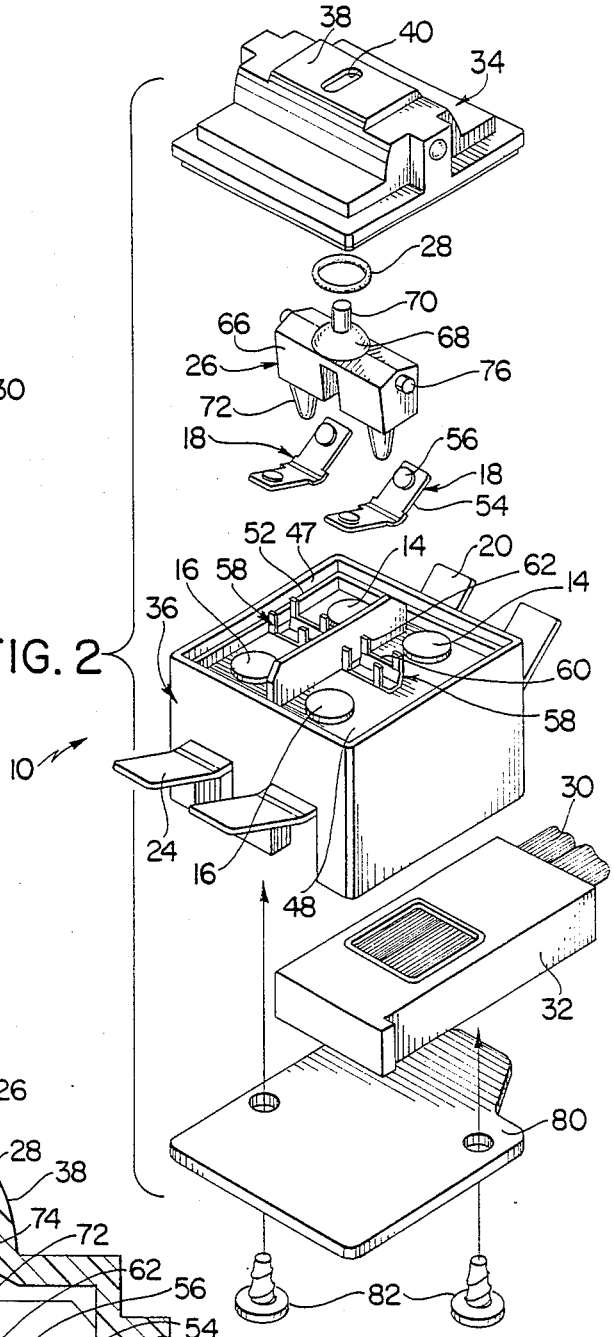
FIG. 2 is an exploded perspective view thereof.
Figure 3:
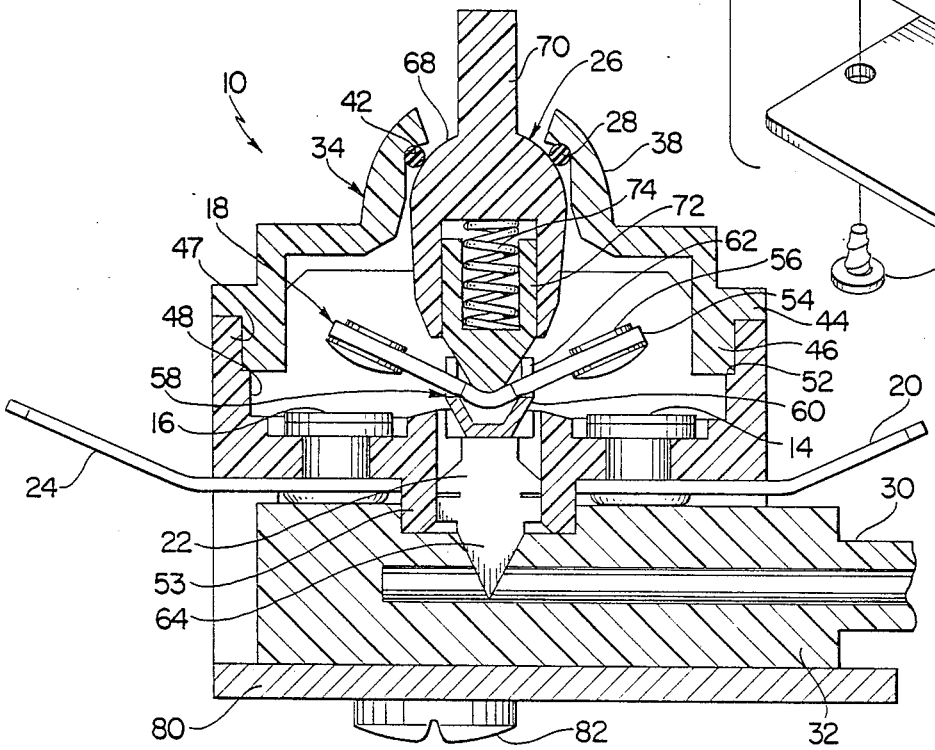
FIG. 3 is an enlarged sectional view taken along line 3—3 in FIG. 1.

Referring now to the drawing, the switch construction of the instant invention is illustrated in FIGS. 1–3 and generally indicated at 10. The switch 10 comprises a housing generally indicated at 12, a pair of first fixed contacts 14 in the housing 12, a pair of second fixed contacts 16 in the housing 12, and a pair of movable contact assemblies generally indicated at 18 in the housing 12. The switch 10 further comprises a pair of first external electrical terminals 20, a pair of second external electrical terminals 22, a pair of third external electrical terminals 24, an actuator assembly generally indicated at 26, and an O-ring 28 which is received in the housing 12 and assembled with the actuator assembly 26 to provide a watertight seal between the actuator assembly 26 and the housing 12. The switch 10 as herein illustrated is adapted for use in combination with an electrical cord 30 having a end piece 32; although it will be understood that other embodiments of the switch of the instant invention which are adapted to be electrically connected to various other types of cords are contemplated. Further, while the switch 10 as herein embodied comprises a double-pole, double-throw switch, it will be understood that the swtich construction of the instant invention can also be effectively embodied in a variety of other types of switches.

The housing 12 comprises first and second housing sections 34 and 36, respectively, which are preferably molded from a suitable electrical insulating plastic material. The first housing section 34 includes an upper portion 38 having an elongated aperture 40 therein, and the housing section 34 is adapted and dimensioned for pivotably mounting the actuator assembly 26 in the upper portion 38 thereof. The upper portion 38 is formed with a substantially circular inner seat 42 therein which extends around the aperture 40 in slightly outwardly spaced relation thereto, and the seat 42 is adapted and dimensioned for receiving the O-ring 28 therein so that it is received in sealed engagement with the inner surface of the first housing section 34. The first housing section 34 is further formed so that it includes an outwardly extending peripheral flange 44 adjacent the lower extremity thereof and a downwardly extending flange 46 which is spaced inwardly slightly from the outer perimeter of the flange 44. The second housing section 36 includes an outer wall 47 which defines the perimeter of an open interior area 48 therein, and the interior area 48 is divided by an integrally molded interior partition 50. Formed on the inner side of the outer wall 47 is a ridge 52 which is spaced downwardly slightly from the upper edge of the outer wall 47, and formed on the bottom side of the bottom wall of the second housing section 36 is a frame 53. The first and second housing sections 34 and 36, respectively, are constructed so that the first housing section 34 is receivable in assembled relation with the second housing section 36 with the outer side of the downwardly extending flange 46 in engagement with the inner side of the outer wall 47 of the second housing section 36, with the lower extremity of the flange 46 resting on the ridge 52 and with the outwardly extending peripheral flange 44 resting on the upper edge of the outer wall 47 as illustrated in FIG. 3. The first and second housing sections 34 and 36, respectively, are preferably ultrasonically sealed together so that the flanges 44 and 46 are sealed to the adjacent portions of the outer wall 47 in order to provide an effective watertight seal between the first and second housing sections 34 and 36, respectively.

The first fixed contacts 14 are disposed on opposite sides of the partition 50 in the interior area 48 of the second housing section 36, and the second fixed contacts 16 are similarly positioned on opposite sides of the partition 50 but in spaced relation to their respective first fixed contacts 14. The first and second fixed contacts 14 and 16, respectively, preferably comprise conventional rivet-like contact members, and they extend through the bottom wall of the second housing section 36, and the first and third terminals 20 and 24, respectively, are assembled with the first and second fixed contacts 14 and 16, respectively, on the underside of the bottom wall of the second housing section 36. In this connection, the first and second fixed contacts 14 and 16, respectively, are snugly received in apertures in the bottom wall of the second housing section 36, and the lower ends thereof are peened over to firmly secure them in position so that they effectively pass in sealed watertight relation through the bottom wall of the second housing section 36.

The movable contact assemblies 18 each comprise an angularly shaped metallic rocker member 54, a pair of contact elements 56 which are mounted adjacent opposite ends of the rocker member 54 thereof, and a metallic contact cradle 58. Each of the contact cradles 58 is preferably integrally formed with one of the second terminals 22, and each preferably comprises a pair of spaced upwardly extending cradle walls 60 and two pairs of spaced upwardly extending retainer members 62 which are positioned at opposite ends of the cradle walls 60 thereof. Each of the rocker members 56 is received on the cradle 58 thereof so that it can rock on the upper edges of the cradle walls 60 thereof, between a first position wherein one of the contact elements 56 on the rocker member 54 is in engagement with the respective adjacent first fixed contact 14 thereof, a second or intermediate position wherein both of the contact elements 56 on the rocker member 54 are in spaced disengagement from their respective adjacent first and second fixed contacts 14 or 16, respectively, thereof, and a third position wherein one of the contact elements 56 on the rocker member 54 is in engagement with the respective adjacent second fixed contact 16 thereof.

The first and third terminals 20 and 24, respectively, comprise conventional metal terminal blades, and each of the first terminals 20 is secured to one of the first contacts 14, whereas each of the third terminals 24 is secured to one of the second contacts 16 as hereinabove set forth. Each of the second terminal elements 22 is preferably integrally formed with the respective cradle 58 thereof, and each includes a pointed prong 64 which is adapted to penetrate the insulation of the power cord 30 in order to electrically connect the respective cradle 58 thereof and the respective movable contact 18 thereof to a conductor in the power cord 30. Each of the second terminal blades 22 is assembled in a slot in the second housing section 36 so that the prong 64 thereof passes through the area defined by the frame 53 and projects downwardly from the bottom wall of the second housing section 36.

The actuator assembly 26 preferably comprises a body portion 66, an upper hemispherical portion 68, and an actuator arm 70, all of which are preferably integrally molded from a low-friction material, such as nylon. The actuator arm 70 extends upwardly from the upper hemispherical portion 68, and a pair of downwardly opening bores 71 are formed in the body portion 66. The actuator assembly 26 further comprises a pair of plunger elements 72 which are slidably received in the bores 71 and biased outwardly with springs 74. A pair of pivot elements 76 are formed on the opposite ends of the body portion 66 and are rotatably received in notches (not shown) in the upper portion 38 of the first housing section 34 in order to pivotably mount the actuator assembly 26 in the housing 12 so that the actuator arm 70 projects outwardly through the aperture 40.

The O-ring 28 preferably comprises a conventional O-ring made of a relatively hard, rubberized material, and it is received in the seat 42 so that it extends around the aperture 40 in the upper portion 38 of the first housing section 34. The actuator assembly 26 is assembled in the upper portion 38 so that the O-ring 28 is disposed in sealed engagement with the outer surface of the substantially hemispherical portion 68 and so that the O-ring 28 passes over the surface of the substantially hemispherical portion 68 as the actuator assembly 28 is pivoted in the housing 12.

The power cord 30 comprises a conventional two-conductor power cord including an insulation layer, and it is assembled with the switch 10 so that each of the conductors of the cord 30 is penetrated by one of the prongs 64. The end piece 32 is preferably integrally molded around the end portion of the power cord 30 from a suitable insulating material, such as a resilient polymer, and includes a recessed area 78 which is dimensioned for receiving the frame 53 on the underside of the second housing section 36. The end piece 32 is secured to the underside of the second housing section 36 with a retainer plate 80 and a pair of screws 82 which firmly press the end piece 42 into sealed engagement with the underside of the second housing section 36 with the frame 53 received in the recessed area 78. Accordingly, the end piece 32 provides an effective seal between the cord 30 and the underside of the second housing section 36 which effectively prevents moisture from reaching the prongs 64 thereof.

For use and operation of the switch 10, the power cord 30 is assembled with the underside of the second housing section 36 so that the prongs 64 of the second terminal elements 22 penetrate the power cord 30 make electrical contact with the conductor wires therein. The plate 80 is then secured to the second housing section 36 in the manner hereinabove set forth to provide a seal around the electrical connections between the second terminal elements 22 and the power cord 30, and various appropriate conductors are assembled with the first and third terminal elements 20 and 24 in a conventional manner. The actuator arm 70 can then be manipulated to move the movable contact assemblies 18 between the first positions thereof wherein they are in engagement with the first fixed contacts 14, the second positions thereof wherein they are in spaced disengagement from their respective first and second fixed contacts 14 and 16, and the third positions thereof wherein they are in engagement with their respective second fixed contacts 16. In this connection, when the actuator assembly 26 is in the first position thereof, the conductor wires in the power cord 30 are electrically connected to the first terminal elements 20, and when it is in the second position thereof, the power cord 30 is disconnected from both the first terminal elements 20 and the third terminal elements 24. When the actuator assembly 26 is in the third position thereof, the conductor wires in the power cord 30 are electrically connected to the third terminal elements 24. In any case, as the actuator assembly 26 is moved between the first, second and third positions thereof, the O-ring 28 passes over the surface of the upper hemispherical portion 68 to provide an effective watertight seal between the first housing section 34 and the actuator assembly 26. In this connection, since the substantially hemispherical portion 68 is preferably made from a low-friction polymer, such as nylon, the O-ring 28 can effectively pass over the surface of the hemispherical portion 68 with a minimum of frictional resistance, and as the actuator assembly 26 is moved between the first, second and third positions thereof, the plunger elements 72 effectively enable the rocker members 54 to rock in the cradles 58 thereof so that the switch 10 is operative with snap action for movement between the first, second and third positions thereof.

It is seen, therefore, that the instant invention provides an effective water-resistant switch construction which is adapted for use in small appliances, such as hair dryers and the like. In this regard, the switch 10 is relatively simple in its overall construction and operation, although the O-ring 28 and the hemispherical portion 68 cooperate to provide an effective seal between the actuator assembly 26 and the first housing section 34. Further, the first housing section 34 is ultransonically sealed to the second housing section 36 to provide an effective watertight seal between the two housing sections 34 and 36. For these reasons, the switch 10 is highly resistant to moisture penetration so that it can be safely and effectively utilized in connection with various small appliances. Hence, it is seen that the switch 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a switch construction of a type comprising a housing including first and second molded, plastic housing sections, said first housing section having an aperture therethrough, fixed and movable contacts in said housing, first and second electrical terminals on the exterior of said housing electrically connected to said fixed and movable contacts, respectively, and an actuator pivotably mounted in said housing, said actuator including an actuator arm which passes through said aperture in said first housing section, said actuator arm being manipulatable from the exterior of said housing for pivoting said actuator to move said movable contact between a first position wherein it is in engagement with said fixed contact and a second position wherein it is in spaced disengagement therefrom, the improvement comprising an O-ring mounted in the interior of said first housing section and extending around said aperture, said actuator further comprising an elongated body portion, a pair of aligned pivot pins, one of said pivot pins extending outwardly from each end of said body portion, said pivot pins being rotatably received in said first housing section for pivotably mounting said actuator therein, a substantially hemispherical portion on said actuator body portion, said O-ring engaging said substantially hemispherical portion to effect a seal between said actuator and said first housing section around said aperture and passing in sealed relation over the surface of said substantially hemispherical portion as said actuator is pivoted in said housing, said actuator arm extending outwardly from said substantially hemispherical portion and through said aperture.

2. In the switch construction of claim 1, said actuator further comprising a spring loaded plunger element, said plunger element engaging said movable contact to move said movable contact between said first and second positions thereof as said actuator is pivoted.

3. In the switch construction of claim 1, said first and second housing sections being ultrasonically sealed together.

4. In the switch construction of claim 2, said substantially hemispherical portion being made of a low-friction polymer.

5. In the switch construction of claims 1, said first housing section having a substantially circular seat formed therein, said seat being dimensioned and configured for receiving said O-ring therein and extending around said aperture, said O-ring being received in said seat.

* * * * *